United States Patent [19]

Fraser, Jr. et al.

[11] Patent Number: 5,007,810

[45] Date of Patent: Apr. 16, 1991

[54] SCROLL COMPRESSOR WITH UNITARY CRANKSHAFT, UPPER BEARING AND COUNTERWEIGHT

[75] Inventors: Howard H. Fraser, Jr., Lafayette; Thomas R. Barito, East Syracuse, both of N.Y.

[73] Assignee: Carrier Corporation, Syracuse, N.Y.

[21] Appl. No.: 445,552

[22] Filed: Dec. 4, 1989

[51] Int. Cl.[5] ..... F04B 35/04; F04C 18/04; F04C 29/00

[52] U.S. Cl. ..... 417/410; 418/55.1; 418/151

[58] Field of Search ..... 418/55 R, 151, 55.1; 417/410

[56] References Cited

U.S. PATENT DOCUMENTS

| | | | |
|---|---|---|---|
| 3,874,827 | 4/1975 | Young | 418/57 |
| 4,564,339 | 1/1986 | Nakamura et al. | 417/366 |
| 4,696,628 | 9/1987 | Kimura et al. | 418/55.1 |

FOREIGN PATENT DOCUMENTS

| | | | |
|---|---|---|---|
| 60-224986 | 11/1985 | Japan | 418/151 |
| 61-8487 | 1/1986 | Japan | 418/55 R |

*Primary Examiner*—John J. Vrablik

*Attorney, Agent, or Firm*—Wall & Roehrig

[57] ABSTRACT

A scroll-type compressor or other rotating machine employs a crankshaft having an integral counterweight to compensate for the off-axis orbiting motion of the device's orbiting scroll. The crankshaft is unitarily formed with a generally cylindrical crank portion at an upper end of the shaft, and with the counterweight formed immediately adjacent the crank. The counterweight is preferably in the form of a segment of a cylinder of smaller radius than that is disposed within the radius of the cylindrical passage of the stator. This permits the rotor and shaft assembly, with counterweight, to be assembled from below after installation of the stator.

5 Claims, 1 Drawing Sheet

SCROLL COMPRESSOR WITH UNITARY CRANKSHAFT, UPPER BEARING AND COUNTERWEIGHT

BACKGROUND OF THE INVENTION

This invention relates to rotating pumps or compressors of the scroll type, and is more particularly directed to an improved construction involving an integral shaft and counterweight.

Scroll type compressors have been known, in principle, for several decades In general, a scroll-type compressor or similar machine comprises a pair of mating scrolls, each of which has an involute spiral wrap of similar shape, mounted on respective base plates. Normally, one scroll is held fixed, and the other is orbited to revolve, but not rotate, being held by an Oldham ring or other anti-rotating structure. The walls of the two involute wraps define crescent-shaped volumes which become smaller and smaller and move from the outside to the center of the mating scrolls as the orbiting scroll revolves. A compressible fluid, such as a refrigerant gas, can be introduced at the periphery of the spiral wraps, and is compressed as it is moved under the orbiting motion of the device. The compressed fluid is then discharged at the center. By introducing a compressed fluid at the center and permitting its expansion to drive the device, the scroll machine can be used as a motor.

However, the orbiting motion of the moving scroll is unbalanced and off axis. Consequently, a moment is involved, which must be appropriately balanced by a suitable counterweight. Current designs for scroll-type compressors or other scroll-type rotating machines are rotationally supported on the rotor shaft between the position of the rotor and the eccentric drive for the orbiting scroll. This requires that the counterweight be positioned a considerable axial distance away from the orbiting scroll that it is intended to counterbalance. Often, the counterweight is attached onto the rotor, and a bearing for the shaft has to be designed to accommodate the rotor-mounted counterweight.

Where the counterweight is a separate part that must be attached to the rotor or shaft, an additional assembly step is required. Also, the counterweight can possibly become loose under severe use or after prolonged operation, thus limiting the reliability of the compressor.

OBJECTS AND SUMMARY OF THE INVENTION

It is an object of this invention to provide a scroll compressor of improved design which avoids the drawbacks of the prior art.

It is a more specific object of this invention to provide a scroll-type compressor in which the counterweight is an integral part of the crankshaft, permitting the compressor to be made more simply and of fewer parts, while achieving improved vibrational characteristics.

It is a further object of this invention to provide a scroll compressor of greater reliability, and which avoids loosening due to excessive high transient torques, which may occur in compressors of the prior art.

In accordance with an aspect of the present invention, a scroll-type compressor is provided with a rotor shaft that is fabricated so as to have an integral upper bearing and an integral counterweight.

The scroll compressor has a fixed scroll mounted in the housing and an orbiting scroll which is disposed off the axis of the fixed scroll to revolve about the axis of the fixed scroll. A rotation-preventing mechanism holds the orbiting scroll against rotation but permits it to revolve in an orbiting motion. An electric motor drive for the compressor has a stator armature that is mounted within the housing. The stator has a cylindrical passage through it of a predetermined radius to accommodate a rotor assembly that is rotationally journalled within the housing. A generally cylindrical rotor is mounted on the shaft and fits into the generally cylindrical passage of the stator, leaving a small annular gap. There is a generally cylindrical upper bearing formed on an upper end of the shaft. The bearing serves as a crank and has an off-axis void on its upper surface into which fits a stem of the orbiting scroll. A radial compliance device can favorably be employed here.

Immediately adjacent the bearing on the shaft is the counterweight which is in the form of a segment of a cylinder and which is disposed radially opposite the offset represented by the orbiting scroll. The counterweight is disposed entirely within a radius equal to the predetermined radius of the stator passage. This permits the rotor assembly to be installed from below by inserting it through the stator.

A rotor counterweight, in the form of a half ring, is mounted onto the lower end of the rotor, radially opposite to the position of the main, integral counterweight.

The lower end of the shaft is supported in a lower bearing.

With this integral shaft design, inventories are reduced because fewer parts are required, and an assembly step is eliminated in production, as the counterweight does not require a mounting step to attach either to the shaft or to the rotor. Because the shaft and counterweight are all one piece, there is no possibility of the counterweight coming off or becoming loose.

The above and many other objects, features and advantages of this invention will present themselves to those skilled in the art from a reading of the ensuing detailed description, which is to be considered in connection with the accompanying Drawing.

DETAILED DESCRIPTION OF THE PREFERRED EMBODIMENT

Figure 1:
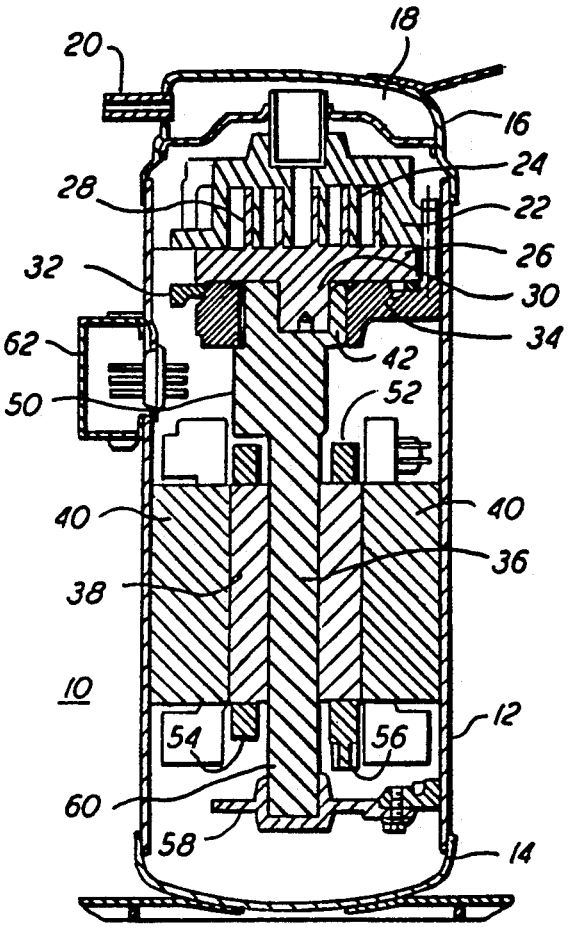
FIG. 1 is a longitudinal sectional view of a scroll-type compressor according to one preferred embodiment of this invention.

With reference to the Drawing, FIG. 1 shows a scroll compressor assembly 10 of the type which can be used with a refrigeration or air conditioning system. The assembly 10 has a generally cylindrical shell or housing 12, which is closed off at its lower end with a lower cap 14 and is closed off at its upper end with an upper cap 16. A pressure dome 18 in the cap 16 holds gas that is compressed in the compressor and conducts it to a high pressure outlet 20 from the center of a fixed scroll 22 that is rigidly mounted within the housing 12. The fixed scroll 22 has an involute or spiral wrap 24. The assembly 10 also has an orbiting scroll 26 with a similar involute wrap 28 that interleaves with the wrap 24 of the fixed scroll 22. A male stub 30 depends from the orbiting scroll 26 at the center or axis thereof.

Figure 2:
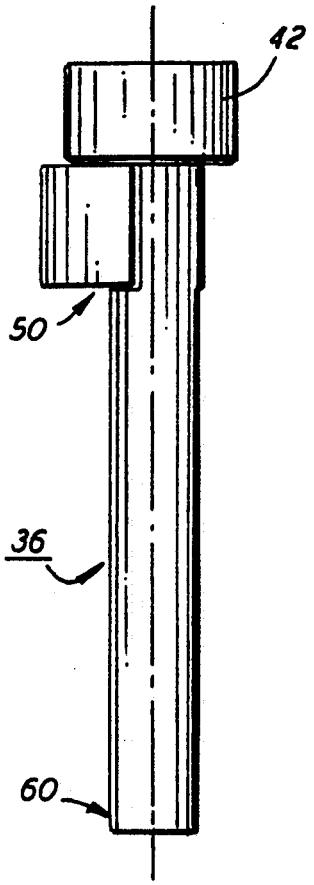
FIG. 2 is a side elevation of a rotor crank shaft according to this embodiment of the invention.
Figure 4:
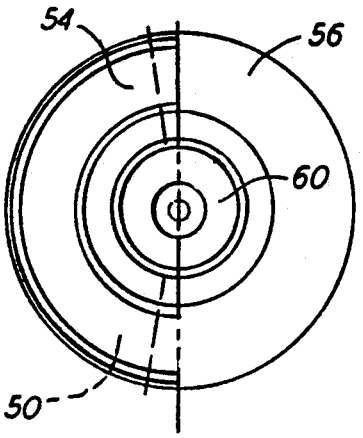
FIG. 4 is a bottom plan view of the shaft and rotor assembly.
Figure 3:
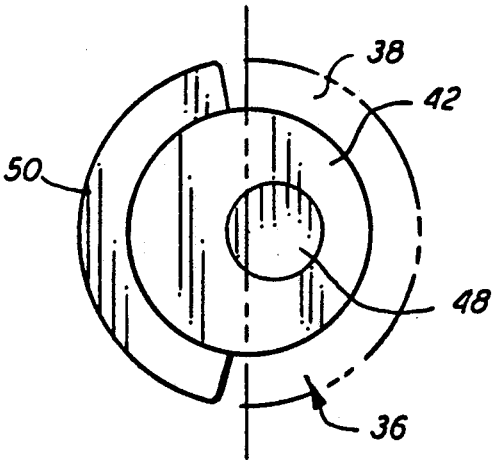
FIG. 3 is a top plan view of the shaft and rotor assembly.

An anti-rotation device, such as an Oldham's ring 32 is associated with the orbiting scroll 26 to prevent rotation of the orbiting scroll, but while permitting it to revolve without rotation around the axis of the fixed scroll 22. A crankcase 34 and bearing are situated within the housing 12 just below the orbiting scroll 26. A one-piece crankshaft assembly 36 as shown in FIG. 2 can be unitarily cast of ductile iron or an equivalent material.

A generally cylindrical electrical rotor 38 is press fit onto the shaft 36 and fits into a cylindrical passage in an electric motor stator armature 40 that is affixed in place onto the interior of the housing 12. The passage has a predetermined radius, so that a small gap remains between the rotor 38 and the stator 40. The rotor 38 and stator 40 constitute an electric motor for the compressor assembly 10.

A generally cylindrical crank 42 which is unitarily formed on an upper end of the shaft 36 is journalled within the crankcase 34. At the top surface of this crank 42 there is an offset female receptacle or socket 48. The socket 48 serves as a receptacle for the male stub 30 of the orbiting scroll 26.

A counterweight 50 is also unitarily formed on the shaft 36, in this embodiment adjacent crank 42. Preferably, the counterweight 50 is arcuate in form, in the shape of a segment of a cylinder, and here subtending an arc of approximately 160°. The counterweight 50 is disposed to the side opposite the radial position of the offset of the orbiting scroll 26. The counterweight 50 lies at or within the radius of the cylindrical passage in the stator 40. This feature permits the crank and rotor assembly to be installed from below after the stator 40 has been affixed into the housing 12.

The counterweight 50 extends axially downwards to the position of an upper ring 52 on the rotor 38. There is also a lower ring 54 on the rotor 38. A generally semi-circular or half-ring rotor counterweight 56 is affixed onto the lower ring 54 in the position radially opposite that of the counterweight 50. Then, a lower bearing 58 journals a lower end 60 of the shaft 36.

Also shown in FIG. 1 is an electrical connector 62 which connects electrical power to the stator 40.

It should be apparent from the above description that this unitary crankshaft 36, with integral crank 42 and counterweight 50, not only provides simplicity of assembly, but increases the reliability of the compressor. With this assembly, the counterweight 50 is rigidly and permanently situated on the crankshaft 36, and is situated as close as possible to the axial position of the orbiting scroll 26, thereby providing optimal balancing. Placing the counterweight 50 at the upper end of the crankshaft 36, rather than directly on the rotor 38, minimizes the effect of destructive transient torques, and thereby further increases the reliability of the compressor 10.

While this invention has been described in detail with reference to a single preferred embodiment, it should be understood that the invention is not limited to that precise embodiment. Rather, many modifications and variations would present themselves to those of skill in the art without departing from the scope and spirit of this invention, as defined in the appended claims.

What is claimed is:

1. A scroll compressor of the type including a shell which contains a fixed scroll and an orbiting scroll which is disposed off the axis of the fixed scroll for revolving about the axis of the fixed scroll, rotation-preventing means for holding the orbiting scroll against rotation but permitting it to revolve in an orbiting motion, an electric motor stator mounted within said shell and having a cylindrical passage therethrough of a predetermined radius, an electric motor rotor assembly rotatably journalled within the shell for driving said orbiting scroll in its orbiting motion, the rotor assembly including an elongated crankshaft, a generally cylindrical rotor mounted on said crankshaft and fitting in said generally cylindrical passage of said stator, a crank situated at an upper end of said crankshaft and that is journalled in a journal housing member beneath said orbiting scroll, said crank including eccentric mounting means for driving said orbiting scroll and imparting said orbiting motion thereto, a counterweight on said crankshaft which balances the off-axis orbiting motion of said orbiting scroll, and a lower bearing rotatably journalling a lower end of said crankshaft; wherein the improvement comprises said counterweight being integrally formed with said shaft, said counterweight being disposed within a radius no greater than said predetermined radium so as to be dimensioned to pass through said stator passage upon installation, and said conterweight being formed immediately adjacent the position of said crank below said journal housing, there being no structure other than the rotor assembly within said predetermined radius between said motor stator and said journal housing.

2. The scroll compressor of claim 1 wherein said shaft and said counterweight are unitarily cast of iron.

3. The scroll compressor of claim 1 wherein said counterweight is generally a cylindrical segment, and subtends an arc of about 160°.

4. The scroll compressor of claim 1 further comprising a rotor counterweight mounted on said rotor on an end remote from the first mentioned counterweight and disposed radially opposite the position of the first-mentioned counterweight.

5. The scroll compressor of claim 1 wherein said crank is a generally cylindrical crank member unitarily formed at said upper end of said crank.

* * * * *